US007950465B2

(12) United States Patent
Lopez Rodriguez

(10) Patent No.: US 7,950,465 B2
(45) Date of Patent: May 31, 2011

(54) SYSTEM FOR DEWATERING BOREHOLES BY MEANS OF ALTERNATIVE CYCLES OF VACUUM AND EXHAUST, BASED ON THE PRINCIPLE OF PNEUMATIC DISPLACEMENT

(76) Inventor: Jorge Lopez Rodriguez, Vilafranca del Penedes (ES)

( * ) Notice: Subject to any disclaimer, the term of this patent is extended or adjusted under 35 U.S.C. 154(b) by 209 days.

(21) Appl. No.: 12/210,192

(22) Filed: Sep. 13, 2008

(65) Prior Publication Data

US 2009/0028721 A1 Jan. 29, 2009

Related U.S. Application Data

(63) Continuation-in-part of application No. PCT/ES2007/070052, filed on Mar. 14, 2007.

(30) Foreign Application Priority Data

Mar. 14, 2006 (ES) ..... 200600704

(51) Int. Cl.
*E21B 43/00* (2006.01)

(52) U.S. Cl. ..... 166/369; 166/54.1; 166/72

(58) Field of Classification Search ..... 166/369, 166/54.1, 72
See application file for complete search history.

(56) References Cited

U.S. PATENT DOCUMENTS

| | | | | |
|---|---|---|---|---|
| 3,647,319 | A | 3/1972 | McLean et al. | |
| 3,971,437 | A | 7/1976 | Clay et al. | |
| 3,971,937 | A * | 7/1976 | Kinoshita | 378/33 |
| 4,260,334 | A | 4/1981 | Kelley et al. | |
| 6,672,392 | B2 | 1/2004 | Reitz | |

FOREIGN PATENT DOCUMENTS

| | | |
|---|---|---|
| DE | 1784077 | 10/1971 |
| DE | 4005574 A1 | 8/1991 |
| DE | 4040805 A1 | 6/1992 |
| ES | 2253970 A1 | 6/2006 |
| ES | 397942 | 9/2008 |
| RU | 2232372 C1 | 7/2004 |

* cited by examiner

*Primary Examiner* — William P Neuder
(74) *Attorney, Agent, or Firm* — Richard M. Goldberg

(57) ABSTRACT

A system of de-watering boreholes by alternating cycles of aspiration and expulsion based on pneumatic displacement, includes a double hose to be introduced into a borehole. The double hose includes a flexible outer hose and a flexible inner hose separated by an annular space therebetween, the double hose adapted to reach a full depth of the borehole. The outer hose has an outer diameter less than a diameter of the borehole to provide an annular clearance between the borehole and the outer hose. An upper closing element is connected to an upper end of the double hose outside of the borehole, and has two outlets which permit entry and exit of air and water. A lower closing element is attached to the double hose at a lower end thereof, and includes a foot valve, a filter, and a protective element to serve as a battering ram.

3 Claims, 5 Drawing Sheets

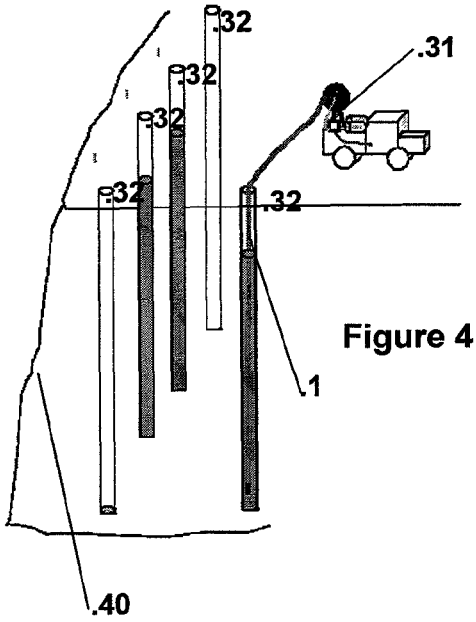
Figure 4
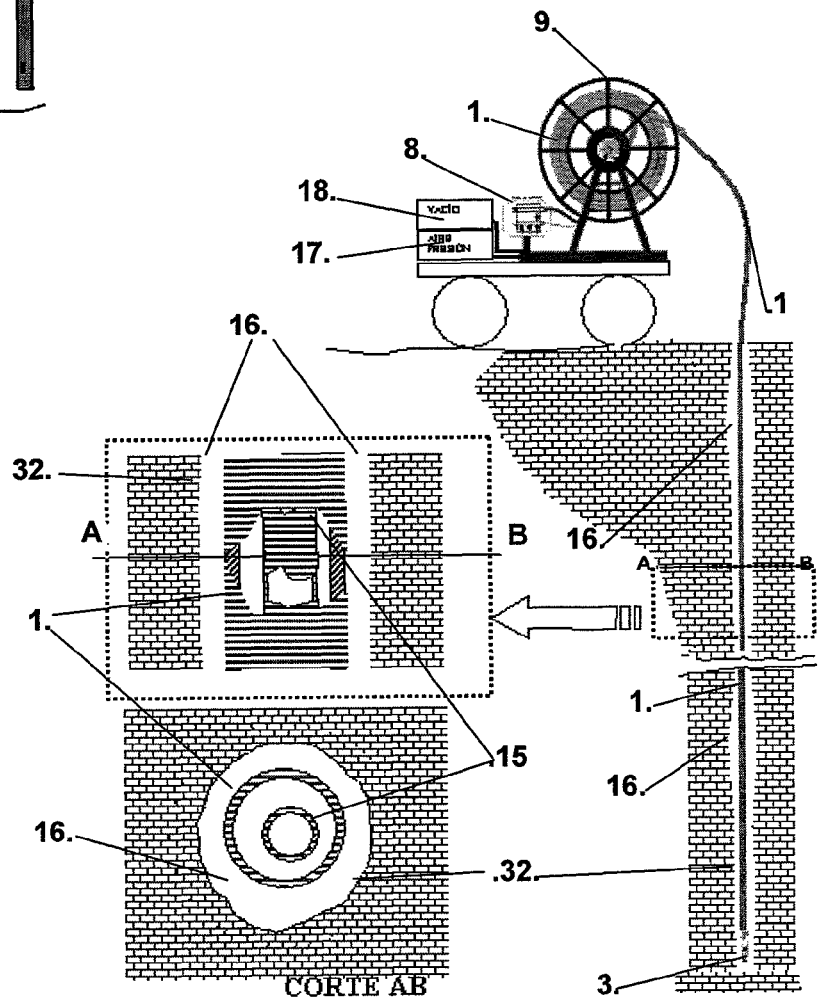
Figure 5
Figure 6

KEY VALVE OPEN
KEY VALVE CLOSED
AIR FLOW (ATMOSPHERIC CONDITIONS
VACUUM
COMPRESSED AIR
WATER FLOW

8
.29
.19
24
.28
41
25
20
.27
23
22
.21
26
1
0
3
6
bars

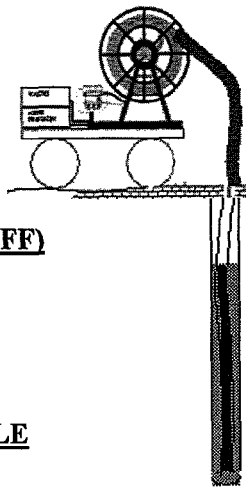
Figure 8a (OFF)
FIRST CYCLE
SECOND CYCLE
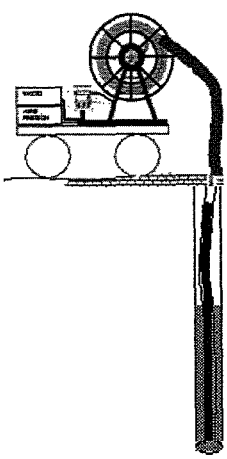
VACUUM PHASE
Figure 8b
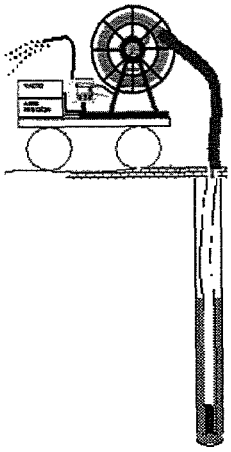
EXHAUST PHASE
Figure 8c
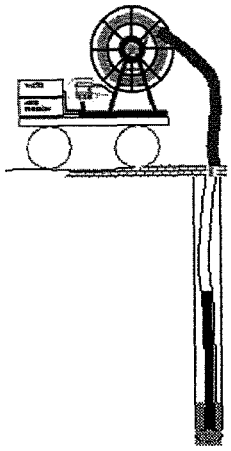
VACUUM PHASE
Figure 8d
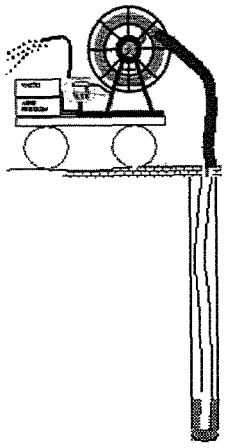
EXHAUST PHASE
Figure 8e
THIRD CYCLE
(DEWATERED HOLE)
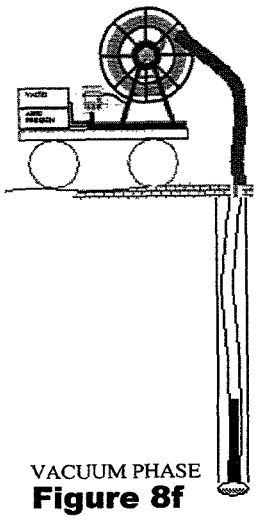
VACUUM PHASE
Figure 8f
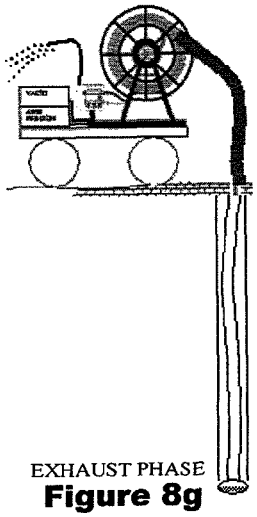
EXHAUST PHASE
Figure 8g
Figure 8

SYSTEM FOR DEWATERING BOREHOLES BY MEANS OF ALTERNATIVE CYCLES OF VACUUM AND EXHAUST, BASED ON THE PRINCIPLE OF PNEUMATIC DISPLACEMENT

BACKGROUND OF THE INVENTION

The invention fits within the Technology field, comprised of devices and/or systems used to dewater boreholes drilled for bench-blasting in quarries and mines.

Water, coming from rain and ground filtration, accumulates very frequently inside boreholes. The presence of water inside a borehole is a serious problem that causes difficulty in loading explosives, reduces their performance and substantially increases the cost of blasting, since the use of more expensive water-resistant explosives is needed.

This invention intends to provide the user of explosives for bench-blasting (in quarries, mines, public works, etc.) with a useful and easy-to-use technical solution that also reduces the possibility of the water extraction system getting stuck, or lost inside the borehole.

All the inventions included in this field of technology can be classified into two main groups:

1. Continuous Systems, such as submersible pumps, and those systems making use of the Venturi Effect.
2. Discontinuous Systems, by which borehole water extraction is carried out in several repetitive cycles.

As a result of the Report of the State of the Art and Previous Examination elaborated by the OEPM, Inventions U.S. Pat. No. 3,647,319 (in forward D1) and U.S. Pat. No. 3,971,437 (in forward D2) are mentioned as the two closest ones to the Invention proposed in this document. Other inventions mentioned by the OEPM were DE 4005574 A1 and U.S. Pat. No. 6,672,392B2.

Pursuant to the previous classification, D2 would be a Continuous System.

Inventions Ref: 397942, D1, ES 2253970, and the present invention P200600704, would be classified as Discontinuous Systems. Within this group, there is a special mention for the sub-group made up of those systems using the physical principle of Pneumatic Displacement as the means to displace water from the borehole. Inventions Ref. 397942, D1, and P200600704 are included in this sub-group. Attention is also drawn to the existence of another sub-division within this Group, made up of those inventions using a vacuum circuit alternately with a compressed-air circuit. This specific design incorporates important operative improvements, despite the resultant major complication in the final design of the invention. Another differentiating feature is that only the Invention P200600704 described in this document can be included in this sub-division. Inventions DE 4005574A1 and U.S. Pat. No. 6,672,392B2 are not related to this specific Technology field (boreholes dewatering) and, therefore, cannot be included in the classification above.

Differences Between P200600704 and D1.

According to what is stated in the original description document of D1, there are substantial differences between the above-mentioned invention (D1) and P200600704, that give this invention substantial operative advantages:

1. A constant clearance is left between the dewatering system and the borehole along its whole length, reducing the risk of the extraction system becoming stuck or lost inside the borehole.

In P200600704, the body of the pump consists of a double hose (1)+(15) with a constant external section. This double hose is inserted into the borehole from a hose reel placed in proximity to the borehole, and it covers its entire length. Thus, a sufficient clearance is left between the internal walls of the borehole and the external face of the hose.

This clearance is kept constant, without any bulges, throughout the length of the borehole.

In contrast, D1 is described as a tubular body (tube) closed at its top end, and inserted into the borehole. It remains connected to the outside by means of two pneumatic hoses with a smaller diameter than that of the tubular body. Therefore, this design, does not maintain a constant clearance between the dewatering system and the borehole along its full length, having a critical point located in the aperture created by the intersection between the tubular body and the two hoses that hold it from the outside. Experience and practice show that those systems that cannot leave a constant clearance between the device and the inner walls of the borehole are very prone to becoming stuck in its interior, resulting in the loss of the device as it cannot then be retrieved.

2. Invention P200600704 uses a flexible hose to confine the volume to be pressurized through the use of a hermetically sealed cap that is placed on the outside of the borehole and any vertical protrusion from the borehole. There is a clear benefit in using a flexible hose because it is easier to extract the hose despite encounters with any obstacles on its way to the surface.

By contrast, D1 uses a rigid tube that, due to the normal conditions of drilling, can never have a length exceeding two or two and a half meters. Since a borehole is never completely straight, it is very difficult to repeat the action of insertion and extraction of the tube. This forces Invention D1, to keep its closing cap located inside the borehole.

3. Vacuum Phase in Invention P200600704: Substantial Improvement in the Performance of Water Extraction Cycles.

The introduction of a Vacuum phase as a part of the dewatering cycles is a fundamental innovation that has not been considered in any previous invention in this field of Technology. This Vacuum phase brings a substantial improvement in the performance of dewatering cycles. This improvement becomes significant in the final cycles, when a smaller volume of water remains in the interior of the borehole, and would normally be very difficult to extract.

Differences Between P200600704 and Other Inventions Mentioned by the OEPM

Invention D2, mentioned in the Report of the Preliminary Study (OEPM), patent (U.S. Pat. No. 3,971,437) in 1976, describes a system similar to the Invention Ref 397942, as it also produces an effect of hermetic sealing against the walls of the borehole. This is done by means of a bladder that is filled with compressed air. Therefore, this cannot be considered to represent any system equivalent to P200600704 (thus excluding its inventive applicability).

In summary, Inventions DE 4005574 A1 and U.S. Pat. No. 6,672,392 B2 cannot be included within this Technology field as they can never be used to dewater boreholes for bench-blasting:

- Both inventions are permanently fixed to the ground by means of a casing (DE 4005574 A1) or by means of a set of metallic pipes (U.S. Pat. No. 6,672,392 B2). By contrast, P200600704 is never fixed to the ground, keeping a clearance between the hose and the inner walls of the borehole along its whole length.
- Both inventions make use of rigid tubes to extract water. By contrast, P200600704 uses a flexible hose to dewater the boreholes.

The objects of these inventions are not related at all to borehole dewatering for bench-blasting:

Extracting water from a large diameter well-hole, in the case of invention DE 4005574 A1

Extracting water and gas from a large diameter well-hole in a gas field, in the case of invention U.S. Pat. No. 6,672,392 B2.

DETAILED DESCRIPTION OF THE INVENTION

Description of the Parts that Constitute the Invention.

The constituent parts of the invention are detailed below in order to facilitate the understanding of the invention, its working principle and its possible use by an expert in the field.

The constituent parts of the invention are:

1. A Main Hose (1) characterized by:

Having a constant external diameter (and without projections) of such a manner that a sufficient and constant clearance is left between the walls of the borehole and the external section of the hose throughout its depth, and at all times during the different cycles of dewatering.

Having a construction strong enough to resist the varying pressure during the essential phases of Vacuum (for example, reaching up to 0.4 atmospheres), and Exhaust (5 atmospheres, for example), thus achieving the optimum operation of the invention. This strength also enables the execution of the Exhaust phase while the main hose remains partially coiled in the reel. This is a significant operational advantage. This situation could arise when dewatering boreholes of different depths (very common, for example, in ramp-blasting, trench-blasting, etc.). Now, it would be possible to extract water from drilled holes of any depth, without needing to change any hose connection. Being flexible along its length, it can also be coiled into a reel, so it can adapt itself to potential deviations that are inherent to drilled boreholes, having a length sufficient to reach the bottom of a borehole of any current depth, while keeping the hose always connected to the reel.

2. A Sealing Cap (2) that is permanently placed at the exterior of the borehole; mounted on the Hose Reel (9) and connected (11) to one of the ends of the Main Hose (1); the top end always remains on the surface; with two air intakes, one of them fitted with an external connection (4) for air circulation (outlet or inlet) through the tube (34), depending on the phase of the cycle: exhaust/vacuum, and another intake with an interior connection (12) to connect the Interior Hose (15); this sealing cap is fitted with an external connection (5) to guide the water towards the Master Control (8) through the pipe (33), and from there to the external point of discharge during the extract phase (Position II, FIG. 7) or to guide the air towards the Master Control (8) and from there to the Vacuum Pump (18) during the Vacuum phase (Position I, FIG. 7). In the Vacuum phase the air is extracted from the interior of both hoses (1)+(15).

3. A Closing Element (30) that mates to the Main Hose (1) at the end that goes down to the bottom of the drilled hole, comprises of a Foot Valve (3), a Filter (13), and a Protective Element (14).

4. An Interior Hose (15). This Interior Hose (15) has a flexible length to enable it to be coiled in the reel. It is permanently connected to the interior connection (12) of the Closing Element (2). Therefore, this Interior Hose (15) remains inside the Main Hose (1) throughout its length during the whole dewatering process.

5. A Master Control (8) that is described later in its simpler variant to facilitate the understanding as to how the invention functions, and its use by an expert in the field. This constitutes the real "heart" of this system of water extraction, alternating the phases of Vacuum and Exhaust.

6. A Small Vacuum System (for example a Vacuum Pump) (18) and a small Compressor (17). They provide sufficient airflow and air pressure for operating the system in both phases (Vacuum: 200 l/s. and 0.2-0.4 bars. Exhaust: 300 l/s and 4-6 bars).

7. A Hose Reel (9) for Coiling the Main Hose (1) (and, consequently, the Interior Hose (15)). It is recommended that the Hose Reel (9) is driven mechanically (for example, by means of an electric motor) ensuring correct ergonomics that would facilitate work conditions for operators. In order to allow the hoses to be coiled without being damaged by torsion, the Hose Reel (9) incorporates one of the following options:

Two swivels (6) and (7) fitted in each of the ends of the axle of the hose reel (9). Shown in FIG. 3 (option 1).

Two concentric swivels, or as shown in FIG. 3 (option 2).

Description of the Functioning of the Invention.

An example is explained below in order to ensure an optimal understanding of the functioning of Invention P200600704. Please note, in order to facilitate the explanation below, the term HOSE will include the components: Main Hose (1), Interior Hose (15), Closing Element (30), Foot Valve (3), Filter (13) and Protective Element (14) as together they constitute a flexible tubular body that is introduced into the borehole.

EXAMPLE

Consider a borehole drilled at a diameter of 127 mm. The water level inside the drilled hole is 10 meters (this is equivalent to approx. 127 liters (12.7 l/m)). The Main Hose (1) is 30 m in length, its outside diameter is 70 mm, its inside diameter is 60 mm, having a thickness of 5 mm. The Interior Hose (15) is also 30 m in length, its outside diameter is 32 mm and its inside diameter is 24 mm. The linear volume of the interior of the HOSE is 2.5 l/m. The invention P200600704 incorporates a Compressor (17) (400 l/min and pressure limited to 6 bar) and a Vacuum Pump (18) of 400 l/min of suction up to a maximum extraction of 0.4 bars (Approx. 6 m of water depth).

Once the vehicle carrying the system P200600704 is positioned in the proximity of the borehole, the process starts by introducing the HOSE partially into the collar of the borehole. Then, by operating the hose reel, the HOSE will go down into the borehole so that, within approximately 15-20 seconds, its end will reach the bottom of the borehole, going through the water level.

The first cycle begins while the HOSE is going into the borehole. The position of the Master Control (8) should be either "0 (Off)" or "I (Suction)" (Position "I" is recommended in order to reduce the overall time of operation by overlapping the introduction of the HOSE and the suction of water by vacuum). In Position "I" valve keys (26) and (28) remain open so that water being sucked up is able to get into both the Main Hose (1) and the Interior Hose (15). Within a few seconds after starting the suction, the interior of the HOSE will be at a pressure of 0.4 bars. (Pressure Gauge (29) will show this value). This is equivalent to 6 additional meters of water inside the HOSE, and the water will reach a total depth of 16 m (10 m (hydrostatic)+6 m (vacuum). Therefore, the volume ready to be extracted in the first phase of Extract will be 40 liters of water (V=16 m×2.5 l/m). Setting the Master Control (8) into Position "II (Extract)" (valve keys (26), (27), (28) closed; valve key (25) opened), the air coming from the compressor (18) enters the Principal Hose (1) across the connection (4) placed in the Closing Element (2). In its journey the air has followed the route: (23)+(20)+(36)+(7)+(35)+(4)+(2)+(1). In this position (Position II) the compressed air penetrates the cavity between the interior hose (15) and the main hose (1), closing the Foot Valve (3) and displacing the water up the interior hose (15) towards the surface along its route: (15)+(12)+(5)+(33)+(6)+(34)+(19)+(24)+(38). After approximately 40-50 seconds with the Master Control (8) set in Position II (see FIG. 7), 40 liters of water will have been extracted in the first cycle and, after this time, only compressed air will be expelled across the Anti-return Valve (24) and the Discharge Hose (38). After the first cycle, approx. 87 liters of water, equivalent to approx. 7 meters of water depth in the drilled hole will remain.

The second cycle begins by setting the Master Control (8) to Position "I (Vacuum)" (closing the key valve (25), and opening the key valves (26) and (28)). Within a few seconds of suction, the Pressure Gauge (29) will indicate approx. 0.4 bars, which means that there will be approximately 32 liters of water in the interior of the HOSE, occupying 13 meters. 7 meters (hydrostatic)+6 meters (vacuum). Moving from Position "I (Vacuum)" to Position "II (Extract)", the above-mentioned volume of water (32 liters) will be extracted toward the point of discharge.

Alternating the phases of Vacuum and Extract through several cycles will achieve a complete dewatering of the borehole. In the worked example, the borehole will be absolutely dry after five cycles (See the attached picture summarizing the example).

| | | |
|---|---|---|
| HOLE DIAMETER | 127.0 | |
| HOLE DEPTH (m) | 20.0 | |
| WATER LEVEL IN THE BOREHOLE (m) | 10.0 | 12.7 l/m |

DIMENSIONS OF MAIN COMPONENTS

| | | |
|---|---|---|
| MAIN HOSE | Long | 30 M |
| DIAMETER ext | | 70 mm |
| DIAMETER int | | 60 mm |
| INTERIOR HOSE | Long | 30 M |
| DIAMETER ext | | 32 mm |
| DIAMETER int | | 24 mm |
| VACUUM | 0.4 atm | 6 m |
| LINEAR VOLUME (l/m) | 2.5 | |

| Cycle | Water Hght (m) | Water Vol. (l) | Extracted Vol. (l) | Remaining Vol. (l) | Remaining Hght. (m) | Dewatered (l) |
|---|---|---|---|---|---|---|
| 1 | 10.0 | 127 | 40 | 87 | 6.9 | 40 |
| 2 | 6.9 | 87 | 32 | 55 | 4.4 | 71 |
| 3 | 4.4 | 55 | 26 | 30 | 2.3 | 97 |
| 4 | 2.3 | 30 | 21 | 9 | 0.7 | 118 |
| 5 | 0.7 | 9 | 9 | 0 | 0.0 | 127 |

Once the borehole has been dewatered, the HOSE is coiled back into the Hose Reel (9). Overlapping the introduction of the HOSE with the first phase of Vacuum, and the withdrawal of the HOSE with the last phase of Extract can save at least 15% of the total time of the process.

It has to be mentioned that, in this Invention, the process can be "reversible" by connecting (33) to (36) and (35) to (34), (i.e. interchanging connections (4) and (5)) in such manner that the same dewatering effect will be achieved but, in this case, the compressed air will be driven through the Interior Hose (15) while the water will be displaced up across the annular gap between the Main Hose (1) and the Interior Hose (15).

BRIEF DESCRIPTION OF THE DRAWINGS

A set of drawings is attached, with the sole purpose of facilitating comprehension of the descriptions of the Invention and its operation.

Main Hose (1)
Interior Hose (15)
Interior Swivel (30)
Foot valve (3)
Filter (13)
Protective Element (14)
Sealing Cap (2)
Outlet Pipes (33) (34)
Swivel (6)
Master Control (8)
Hose Reel (9)
Compressor (17)
Vacuum Pump (18)
Air Pipes (35) (36)
Swivel (7)
Discharge Hose (38)
Discharged Air+water (39)
Anti-return Valve (24)

Figures 1, 2:
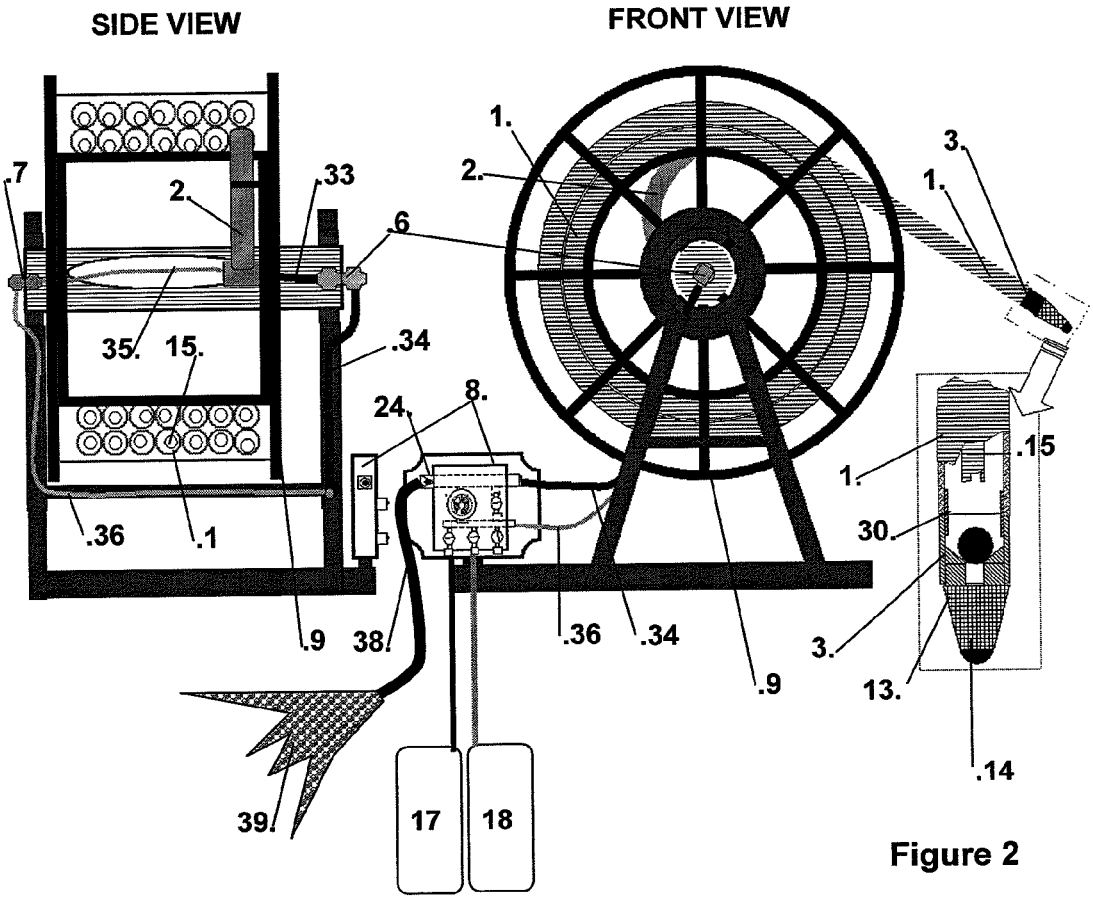
FIG. 1 represents a side and a front view of Invention P200600704. The components shown in the picture are.

FIG. 2 represents a detail view of:

Main Hose (1)
Foot valve (3)
Filter (13)
Protective Element (14)
Interior Hose (15)
Interior Swivel (30)

Figure 3A:
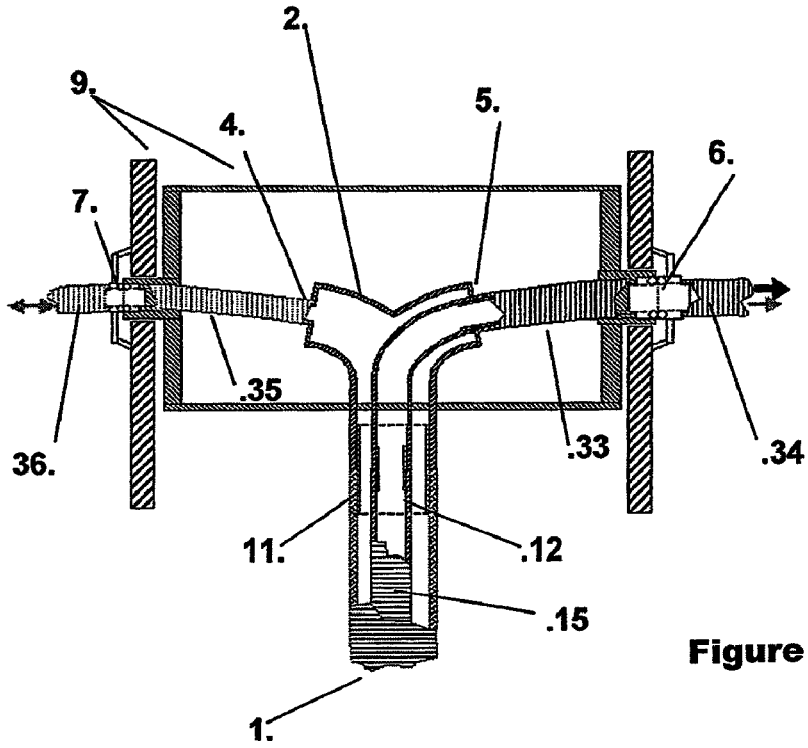
Figure 3B:
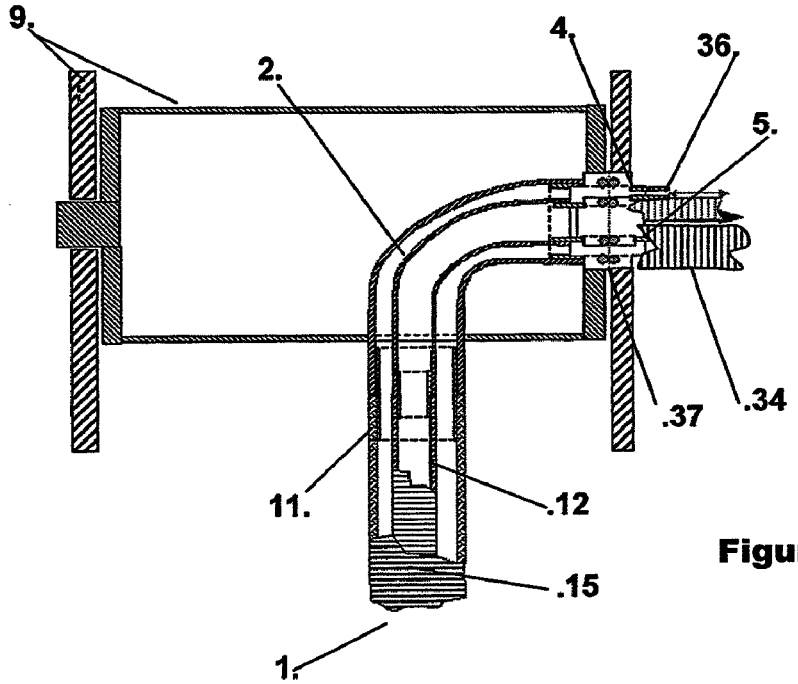

FIG. 3*a* (option 1) and FIG. 3*b* (option 2) represent two existing options for the closing cap being mounted in the axle.

Components shown on the picture are:

Sealing Cap (2)
Swivel (7) [Option 2]
Air Pipes (35) (36)
Connection for Air Inlet/Outlet (4)
Hose Reel (9)
Connection (11) [Main Hose—Closing Cap]
Connection (12) [Interior Hose—Closing Cap]
Main Hose (1)
Interior Hose (15)
Outlet Pipes (33) (34)
Swivel (6) [Option 1]
Connection for Air/Water Outlet (5)
Concentric Double Swivel (37) [Option 2]

FIG. 4 represents a schematic view of the Invention proceeding to borehole dewatering: Invention P200600704 is mounted on a "Pick Up" type vehicle (31) on top of a quarry face (40). The HOSE (1) is introduced into one of the wet boreholes (32)

FIG. 5 represents a longitudinal view of any part of the HOSE inside a borehole. Components represented are:

Borehole (32)
Main Hose (1)
Interior Hose (15)
Clearance [HOSE—Borehole] (16)
Foot valve (3)
Filter (13)
Master Control (8)
Hose Reel (9)
Compressor (17)
Vacuum Pump (18)

FIG. 6 represents a transverse view [A-B Section] details: Components represented are:

Borehole (32)
Main Hose (1)
Interior Hose (15)
Clearance [HOSE—Borehole] (16)

Figures 7A, 7B, 7C:
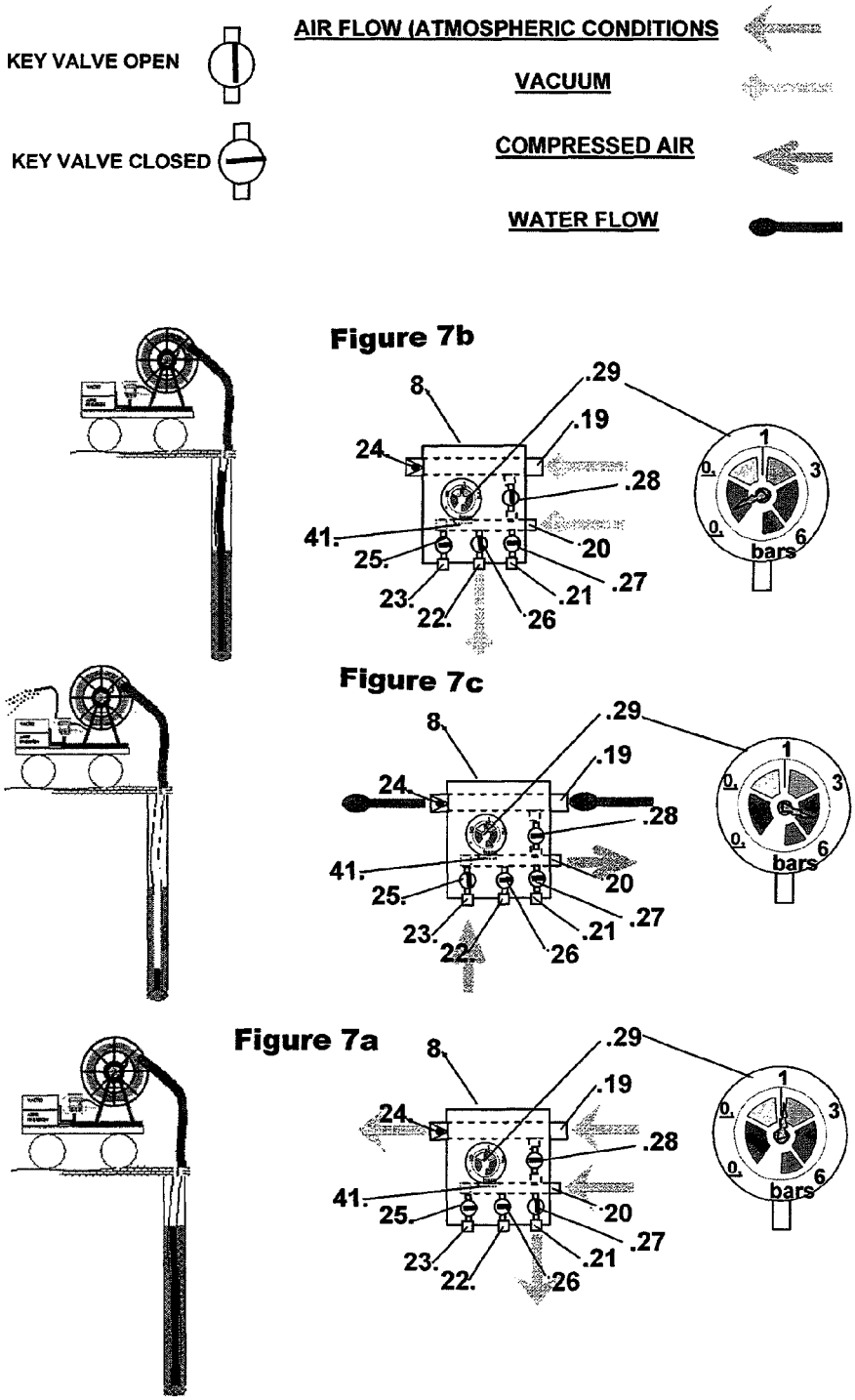

FIGS. 7*a*-7*c* represent the three different positions of the Master Control: FIG. 7*a* corresponding to Position "0 (Off)"; FIG. 7*b* corresponding to Position "I: (Vacuum)"; and FIG. 7*c* corresponding to Position "II: (Extract)". It also indicates the Pressure Gauge and the depth of the water inside the borehole, depending on the position of the Master Control. The elements shown are:

Master Control (8)
Anti-return Valve (24)
Pressure Gauge (29)
Connection to the Pressure Gauge (41)
Compressed Air Flow (orange arrow)
Air Vacuum Flow (yellow arrow)
Water Flow (blue arrow)
Air Flow [at atmospheric conditions] (green arrow)
Key valves controlling the flow of:
[Compressed air from Compressor to Master Control] (25)
[Air from Vacuum pump to Master Control] (26)
[Air from HOSE to the outside] (27)
[Air between Main Hose and Interior Hose] (28)
Connections, connecting:
[Compressor to Master Control] (23)
[Vacuum to Master Control] (22)
[Master Control to Main Hose] (20)
[Master Control to Interior Hose] (19)
[Master Control to the outside] (21)

Description of the Different Positions:

Position "0" (Off): Key valves (25), (26) and (28) remain closed. Key valve (27) remains open. This allows the HOSE to be submerged into the water.

Position "I" (Vacuum): Key valves (28) and (26) remain open. Key valves (25) and (27) remain closed. This connects the Vacuum Pump to the HOSE.

Position "II" (Extract): Key Valves (26) (27) and (28) remain closed. Key valve (25) remains open. This allows the compressed air to enter the Main Hose, displacing the water up through the Interior Hose.

FIGS. 8*a*-8*g* represent a process of borehole dewatering taking place in three cycles of vacuum and extract.

The invention claimed is:

1. A system of de-watering boreholes by means of alternating cycles of aspiration and expulsion based on the principle of pneumatic displacement to extract water from blastholes, comprising:

a double hose to be introduced partly into a borehole until the double hose reaches a bottom of the borehole, the double hose including an outer hose of a first diameter and an inner hose of a second smaller diameter positioned within said outer hose and spaced inwardly from the outer hose by an annular space, both the first and second hoses being flexible along lengths thereof to enable the hoses to adapt to deviations present in the borehole while having sufficient cross-sectional rigidity to enable the double hose to withstand cycles of aspiration and pressure applied to the system without collapsing or bursting, the double hose being adapted to be uncoiled to reach a full depth of the borehole, the outer hose having an outer diameter less than a diameter of the borehole to provide an annular clearance between walls of the borehole and an outer surface of said outer hose;

an upper closing element connected to an upper end of the double hose that is above a surface having the borehole, and located outside of the borehole, the closing element having two outlets which permit entry and exit of air and water, depending on a timing and type of a cycle that determines how one said outlet is connected to the inner tube and to an external hose; and a lower closing element having an external diameter not greater than a diameter of the outer hose, and attached to the double hose at a lower end thereof that is adapted to travel to the bottom of the borehole, the lower closing element including a foot valve, a filter, and a protective element to serve as a battering ram, wherein, within an inner volume of said double hose, a significant level of vacuum is created in order to ensure that a maximum amount of additional water that would equate to a natural level of water in the borehole is trapped within the double hose, during an aspiration phase, and immediately after, supplying compressed air to one of:

an inner volume defined by the annular space between the outer hose and the inner hose, and the inner hose, to force the water, respectively, through one of:

the inner hose, and inner volume defined by the annular space between the outer hose and the inner hose.

2. A system of de-watering boreholes according to claim 1, further comprising a master control for controlling alternating cycles of aspiration and expulsion in said double hose, based on a principle of pneumatic displacement to extract water from the borehole, by alternating connection with the double hose between a vacuum source during the aspiration cycle and a compressed-air source during the expulsion cycle.

3. A system of de-watering boreholes according to claim 1, by alternative cycles of aspiration and expulsion based on a principle of pneumatic displacement to extract water from the borehole, wherein the upper closing element is placed outside of the borehole and away from a part of the double hose that projects out of the bore hole.

* * * * *